US005191685A

United States Patent [19]

Aoki et al.

[11] Patent Number: 5,191,685

[45] Date of Patent: Mar. 9, 1993

[54] BUCKLE FOR WATCH BANDS

[75] Inventors: Yasushi Aoki, Saitama; Masaaki Azuma, Tokyo; Shigeo Tsuchigane, Saitama; Akihiro Tanaka; Katsuzo Hirayama, both of Tokyo; Eiichiro Tanaka, Saitama; Hidehumi Kasai, Tokyo, all of Japan

[73] Assignee: Citizen Watch Co., Ltd., Tokyo, Japan

[21] Appl. No.: 459,832

[22] PCT Filed: Apr. 10, 1989

[86] PCT No.: PCT/JP89/00383

§ 371 Date: Jan. 25, 1990

§ 102(e) Date: Jan. 25, 1990

[87] PCT Pub. No.: WO89/11232

PCT Pub. Date: Nov. 30, 1989

[30] Foreign Application Priority Data

May 27, 1988 [JP] Japan ..... 63-70155[U]
Jan. 6, 1989 [JP] Japan ..... 1-352[U]

[51] Int. Cl.[5] ..... A44C 5/20

[52] U.S. Cl. ..... 24/656; 24/685; 24/589; 24/265 WS

[58] Field of Search ..... 24/656, 68 J, 265 WS, 24/574, 589, 68 R, 580, 585, 586, 596, 625

[56] References Cited

U.S. PATENT DOCUMENTS 4,310,953 1/1982 Nansi ..... 24/656
4,359,808 11/1982 Fontaine ..... 24/265 WS X
4,675,955 6/1987 Nakamura .

FOREIGN PATENT DOCUMENTS 350785 1/1990 European Pat. Off. ..... 24/265 WS
51-76469 6/1976 Japan .
61-168302 7/1986 Japan .
62-188215 11/1987 Japan .
657763 9/1986 Switzerland ..... 24/265 WS
668353 12/1988 Switzerland ..... 24/265 WS

*Primary Examiner*—James R. Brittain

[57] ABSTRACT

A buckle having a lock mechanism for a watch with opposite bands is disclosed. The lock mechanism (40) is provided in a frame member (20) secured to one of the bands (37). The lock mechanism comprises a lock lever (41) having a locking portion and a pressing-up lever (42) having a pressing-up slant, each of the levers being laterally slidably mounted in the frame member, and a spring (43) provided so as to outwardly urge both the levers. A clasp (30) attached to the other band has a lock member corresponding to the lock lever and a pressing-up slant member (34) corresponding to the pressing-up lever. The lock lever engages with the lock member to lock the clasp. When the lock is released, the pressing-up lever pushes up the pressing-up slant member, thereby disengaging the clasp. The locking portion of the lock lever and the pressing-up slant of the pressing-up lever are disposed so as to overlap with each other. An operating lug of one of the levers is bent so that operating lugs of both the levers project from holes formed in side frames of the frame member at the same height.

8 Claims, 9 Drawing Sheets

BUCKLE FOR WATCH BANDS

TECHNICAL FIELD

The present invention relates to a buckle for watch bands.

U.S. Pat. No. 4,675,955 discloses a buckle having a lock mechanism which reliably locks the buckle and can be easily operated by a user. FIGS. 1 to 3 show a buckle disclosed in the U.S. Patent. An engaging projection 4 provided on a clasping member 1 is engaged with an edge 3*a* of an opening 3 formed in a lock member 2, so that the opposite watch bands are connected to each other through the buckle. To disengage the buckle, a projected end of the lock member 2 and a projected end of a pressing up member 5 are simultaneously and inwardly pushed, whereby the engaging projection 4 is released from the edge 3*a* and pushed by the slant of the pressing up member 5. Thus, the clasping member 1 is released from the lock member 2 and pushed up.

However, the buckle has disadvantages as follows. The lock member 2 and the pressing up member 5 are formed by bending metal plates so as to be slidable on guide pins 7. Further, both the members 2 and 5 are vertically disposed as shown in FIG. 3. Consequently, the buckle becomes large in thickness. Further, as shown in FIG. 3, a pair of holes 8 from which the ends of both members are projected are not equal in height. Therefore, the appearance of the buckle is asymmetrical.

The U.S. Patent discloses a further embodiment solving the problem of thickness. However, in the embodiment, the length of the buckle in the longitudinal direction of watch bands is increased. As a result, the buckle becomes large in size, which causes the range of design to reduce.

The object of the present invention is to provide a buckle which may be made in small size with a good appearance.

DISCLOSURE OF THE INVENTION

According to the present invention, there is provided a buckle for a watch with opposite bands, the buckle having a first engaging member connected to one of the bands, a second engaging member connected to the other band, the first engaging member comprising a frame member having a base frame and a pair of side frames each of which has a hole, a lock lever having a locking portion, and a pressing-up lever having a pressing-up slant, each of the levers being laterally slidably mounted in the frame member and having an operating lug projected from the hole of one of the side frames, and the second engaging member comprising a lock member corresponding to the lock lever and a slant member corresponding to the pressing-up lever, characterized in that both the holes are located at the same height, the locking portion of the lock lever and disposed so as to overlap with each other, the operating lug of one of the levers is bent so as to be inserted into the corresponding hole, and a spring is provided between the lock lever and the pressing-up lever so as to outwardly urge both the levers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus, are not limitative of the present invention and wherein:

BEST MODE FOR EMBODYING THE INVENTION

Figure 1:
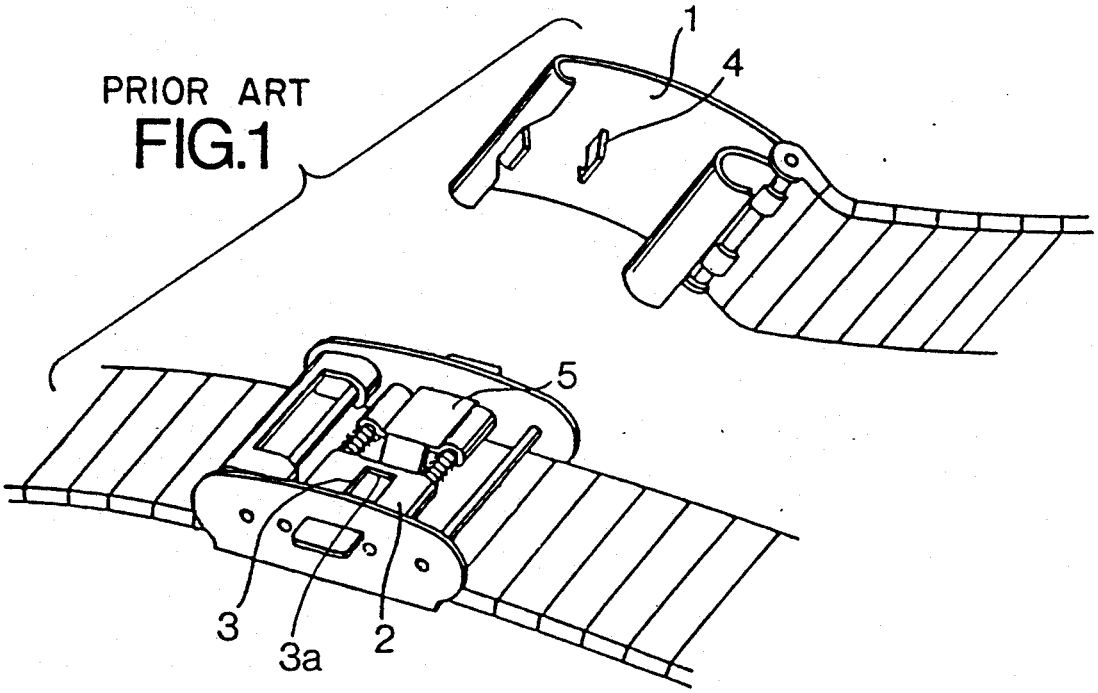
PRIOR ART FIG.1
FIG. 1 is a perspective view of a conventional buckle.
Figure 2:
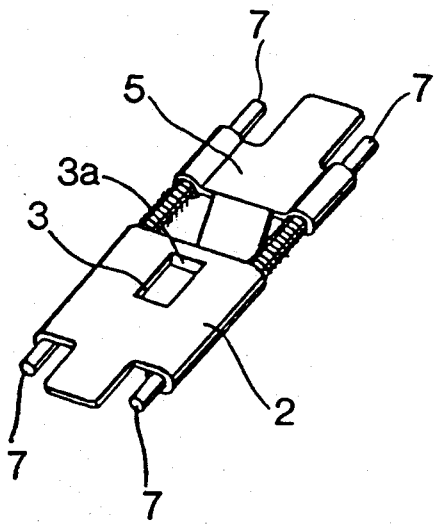
PRIOR ART FIG.2
FIG. 2 is an enlarged perspective view of a lock member of the buckle.
Figure 3:
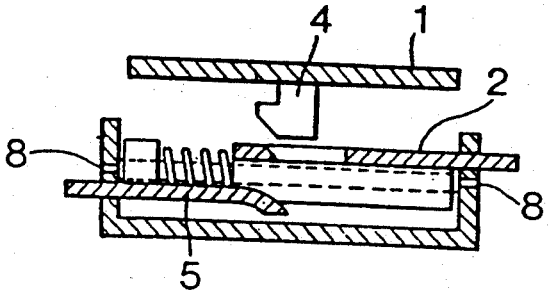
PRIOR ART FIG.3
FIG. 3 is a sectional view showing the engaging state of the buckle.
Figure 4:
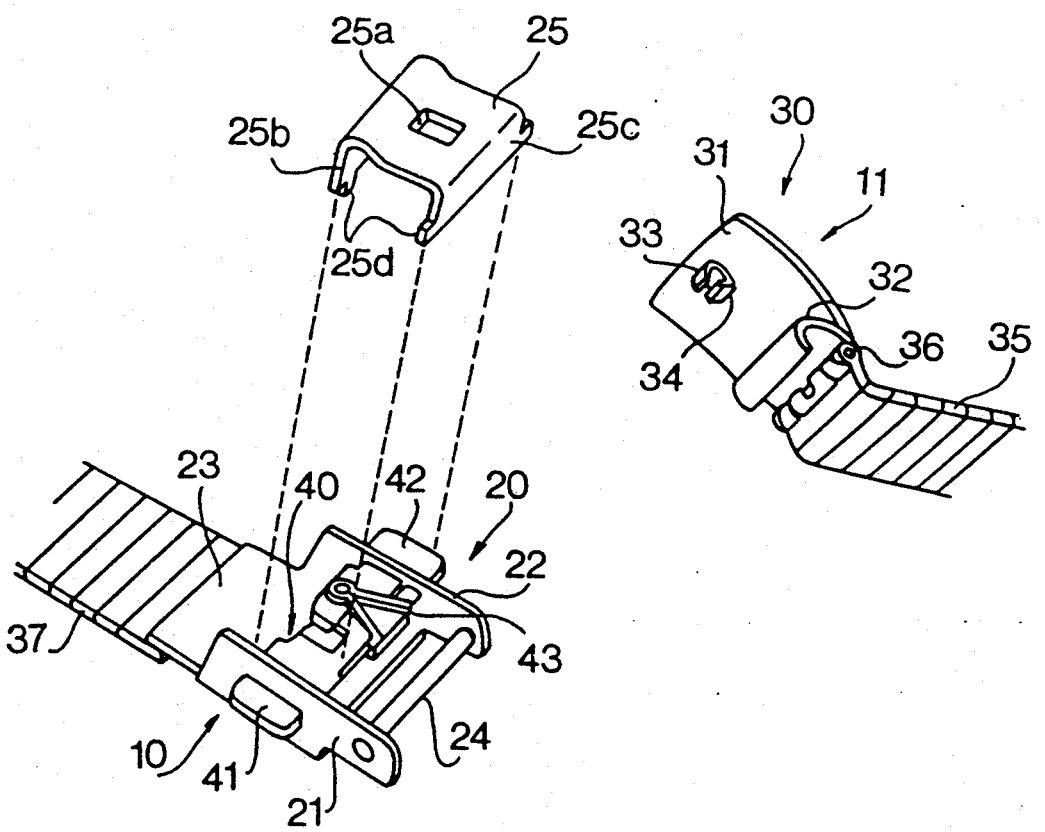
FIG. 4 is an exploded perspective view of a buckle for a watch band according to the present invention.
Figure 5:
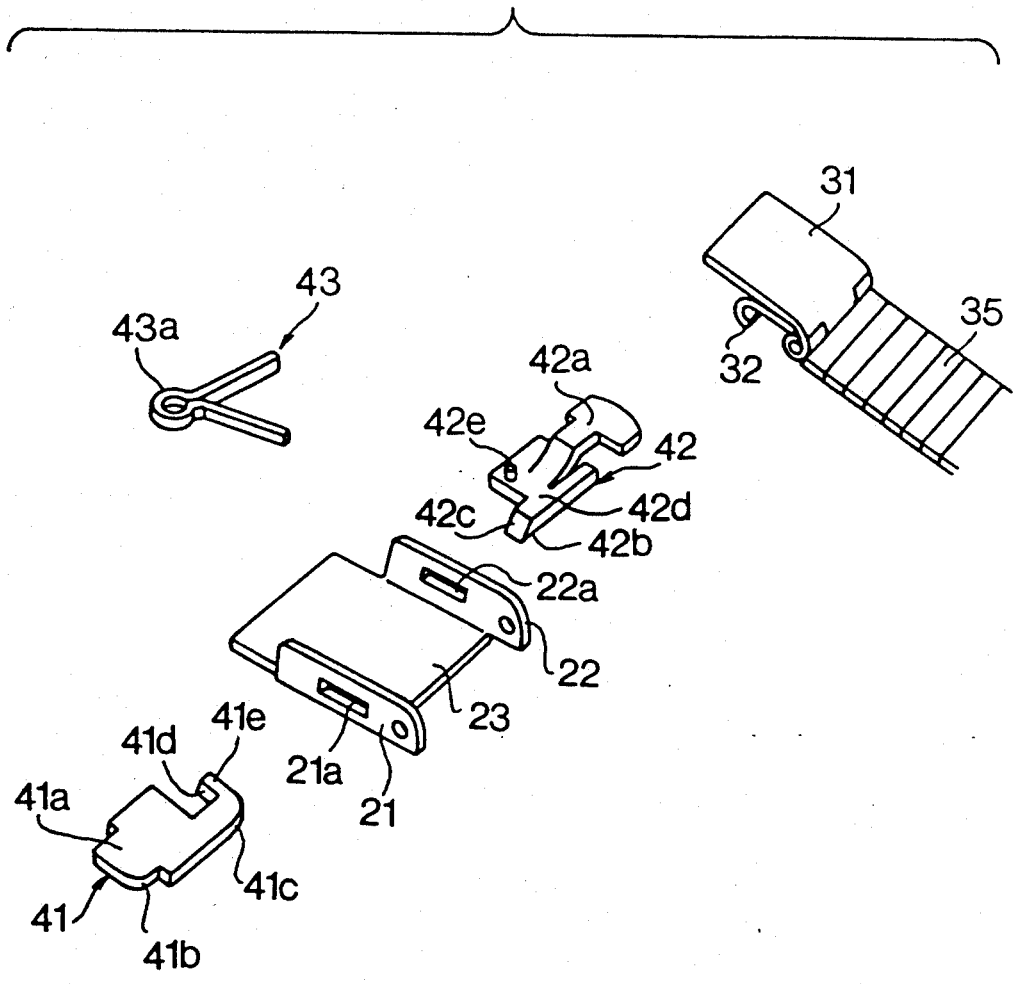
FIG. 5 is an exploded perspective view showing a first engaging member of the buckle shown in FIG. 4.
Figure 6:
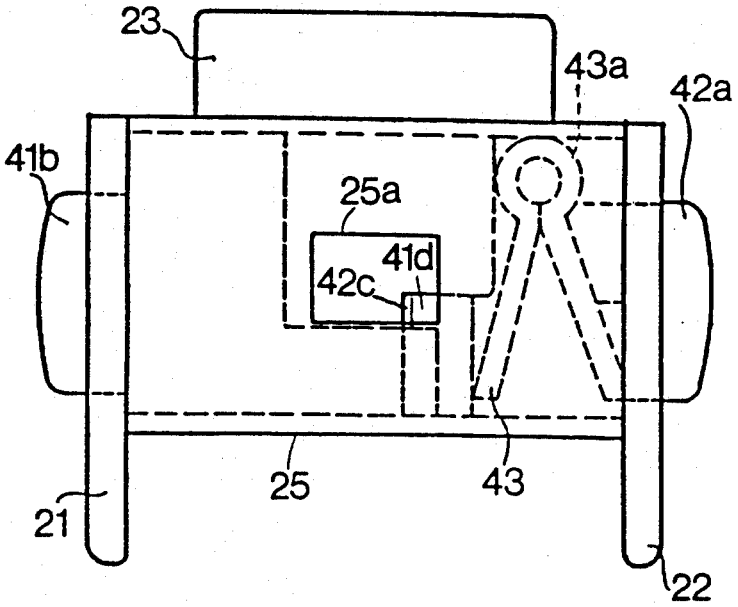
FIG. 6 is a plan view of the first engaging member.
Figure 8:
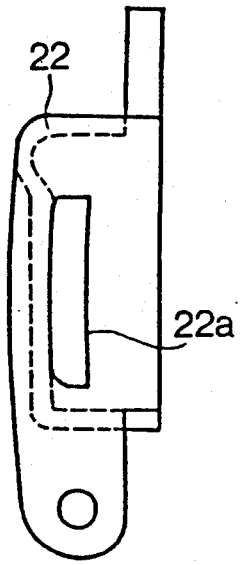
FIG. 8 is a side view of the first engaging member.

Referring to FIGS. 4 to 8, a buckle according to the present invention comprises a first engaging member 10 and a second engaging member 11. The first engaging member 10 comprises a frame member 20, a lock mechanism 40 mounted in the frame member 20 and a cover 25. The second engaging member 11 comprises a clasp 30 and a hook 32. The frame member 20 comprises a base frame 23 and a pair of side frames 21 and 22 integral with the base frame 23, and has an engaging pin 24 laterally provided between the side frames 21 and 22. The clasp 30 has a cover plate 31, a snap 33 and a composite member 34 having a lock member and a slant member. The snap 33 and the composite member 34 are secured to the cover plate 31 by brazing. The snap 33 has a forwardly curved front side which snugly engages with the front side of the opening 25*a* of the cover 25. The clasp 30 and the hook 32 are pivotally connected on a pin 36 provided on an end of a band 35. The base frame 23 is connected to another band 37 by screws.

Figure 7:
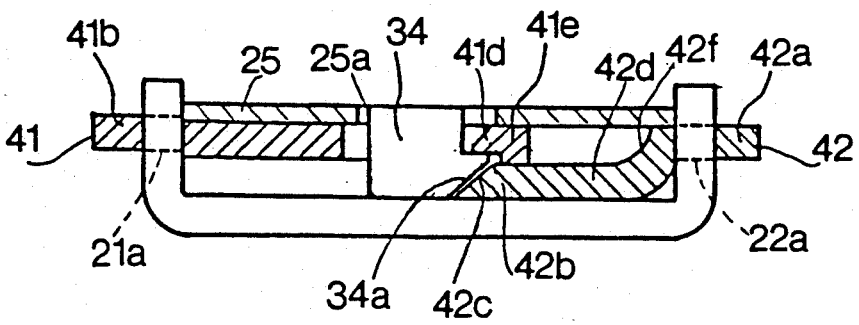
FIG. 7 is a sectional view of the first engaging member.
Figure 9:
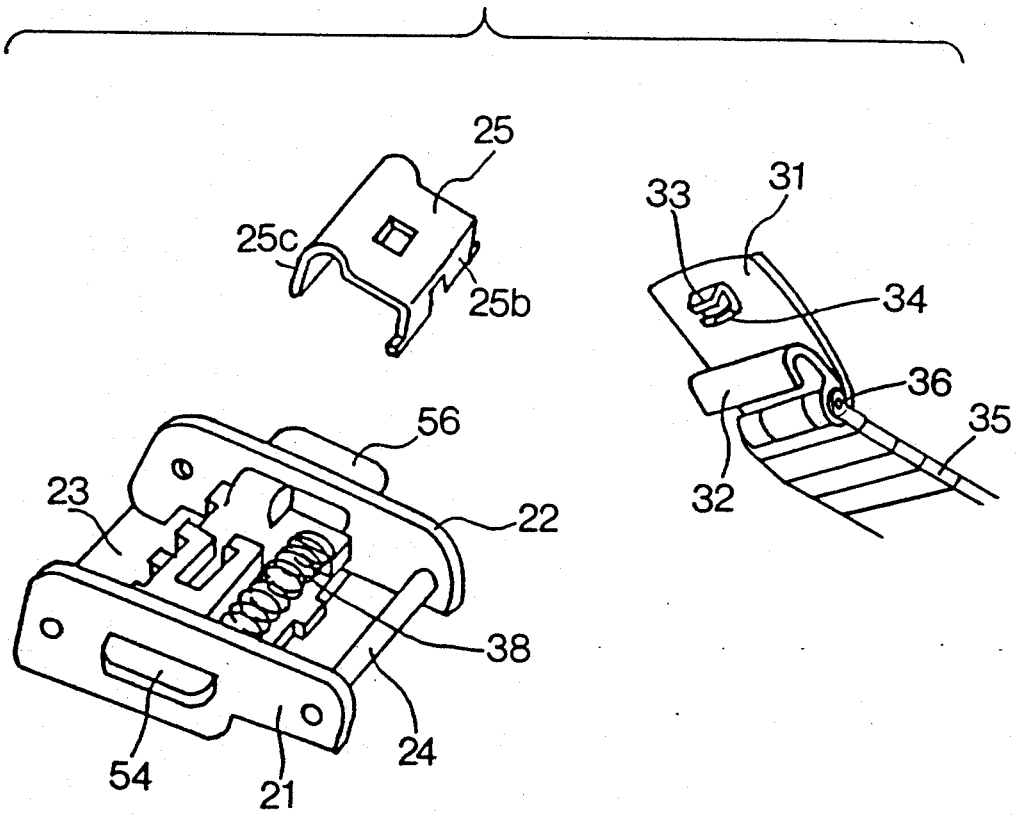
FIG. 9 is an exploded perspective view showing a buckle of a embodiment of the present invention.
Figure 10:
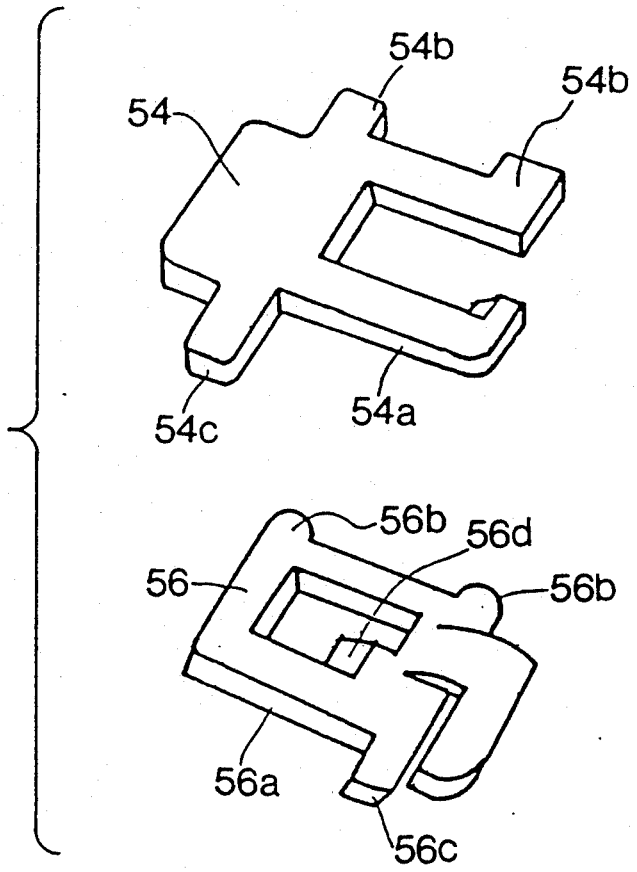
FIG. 10 is an enlarged perspective view showing a lock lever and a pressing up lever of the buckle of FIG. 9.

The lock mechanism 40 comprises a lock lever 41, a pressing-up lever 42, and a spring 43. The lock lever 41 comprises a body 41*a*, an operating lug 41*b* to be projected from a hole 21*a* formed in the side frame 21, and an L-shaped projecting portion 41*c*. As shown in FIG. 7, a locking portion 41*e* having a guide slant 41*d* is formed on the inside of the projecting portion 41*c*. The pressing-up lever 42 has a body 42*d*, and an operating lug 42*a*. The operating lug 42*a* is formed by a pair of parallel slits extending from an outer end of the body 42*d* and upwardly bent by the height which is approximately the same as the thickness of the lock lever 41. An inner projection 42*b* projected from the body 42*d* has an upward slant 42*c* as a pressing-up slant to be abutted on a downward slant 34*a* of the composite member 34.

The cover 25 has side and lower projections 25*d* to be engaged with the frame member 20, and a pair of lateral side plates 25*b* and 25*c* for guiding the levers 41 and 42. The projections 25*d* are engaged with the base frame 23 and the side frames 21 and 22 for mounting the cover 25 on the frame member 20.

As shown in FIG. 7, the body 42*d* of the lever 42 is slidably mounted on the base frame 23 and the lock lever 41 is slidably mounted on the body 42*d*. Since the position of the operating lug 42*a* of the pressing-up lever 42 is higher than the body 42*d* by the thickness of the lock lever 41, the operating lug 42*a* is approximately the same level as the operating lug 41*b*. Both the levers 41 and 42 can be slid between the base frame 23 and the cover 25 secured to the frame member 20.

The operating lugs 41*b* and 42*a* of the lock lever 41 and the pressing-up lever 42 are projected from holes 21*a* and 22*a* formed in the side frames 21 and 22 at the same level with each other. Thus, the operating lugs 41*b* and 42*a* are symmetrical, thereby giving good design. Each of the operating lugs 41*b* and 42*a* has a comparatively long width, so that the lugs do not pain fingers of the user when operating although the plate has a small thickness as 1 mm.

The V-shaped spring 43 has a circle 43*a* at a base portion thereof. The base circle 43*a* engages with a boss 42*e* formed on the body 42*d* of the lever 42. Both ends of the spring 43 are abutted on the projecting portion 41*c* of the lock lever 41 and an upward bent portion 42*f* of the pressing-up lever 42 (FIG. 7), respectively, to urge both levers outwardly in the opposite directions to project the operating lugs 41*b* and 42*a* from holes 21*a* and 22*a*. As shown in FIG. 7, the lock lever 41 is held by the pressing-up lever 42 to form a space under the lock lever 41. The composite member 34 secured to the cover plate 31 is located in the space.

Method of coupling the buckle is as follows. The hook 32 of the clasp 30 is engaged with the pin 24 and the cover plate 31 is rotated so that the snap 33 resiliently and snugly engages with the front side of the opening 25*a* of the cover 25. At the same time, the composite member 34 is inserted into the opening 25*a*. The downward slant 34*a* of the composite member 34 slides on the guide slant 41*d* of the lock lever 41 so that the lock lever 41 is inwardly moved. When the slant 34*a* passes the slant 41*d*, the lock lever 41 is returned to the home position by the elastic force of the spring 43. As shown in FIG. 7, the locking portion 41*e* engages with the composite member 34. Thus, the clasp 30 is locked by the lock mechanism 40.

In operation for disengaging the buckle, the operating lugs 41*b* and 42*a* of levers 41 and 42 are pushed by a thumb and a first finger of the user to release the locking portion 41*e* from the composite member 34, while the upward slant 42*c* of the pressing-up lever 42 pushes the downward slant 34*a* upward. The cover plate 31 is pushed up against engaging force of the snap 33 by the slant 42*c* and released from the cover 25. Then, the hook 32 is disengaged from the pin 24.

In the present invention, the thickness of the buckle is the total thicknesses of base frame 23, both the levers 41 and 42, cover 25 and cover plate 31. Consequently, a comparatively thinner buckle is provided. The lock lever 41 is mounted on the pressing-up lever 42, so that the lateral length of the buckle is reduced.

In accordance with the invention, a thinner and compact buckle is provided, with balanced design and simple structure and may be manufactured by quantity-production work.

FIGS. 9 to 12 show a buckle of the second embodiment of the invention. The buckle of the second embodiment has basically the same construction as the first embodiment. In the second embodiment, a lock lever 54 of the buckle has an L-shaped retainer portion 54*a* and a pressing-up lever 56 has an inverted L-shaped retainer portions 56*a*, each extending from the body. A coil spring 38 is disposed in a space defined by the retainer portions 54*a* and 56*a*, cover 25 and base frame 23. The levers 54 and 56 are further provided with a pair of regulating ends 54*b* and 56*b*, respectively. Both projecting ends 54*c* and 56*c* formed on the L-shaped retainer portions 54*a* and 56*a* also serve as regulating ends The regulating ends 54*b*, 56*b*, 54*c* and 56*c* abut on the side plates 25*b* and 25*c* of the cover 25 so as to guide the levers 54 and 56 in the lateral direction of the band. Therefore, the levers 54 and 56 can be smoothly operated.

Figure 11:
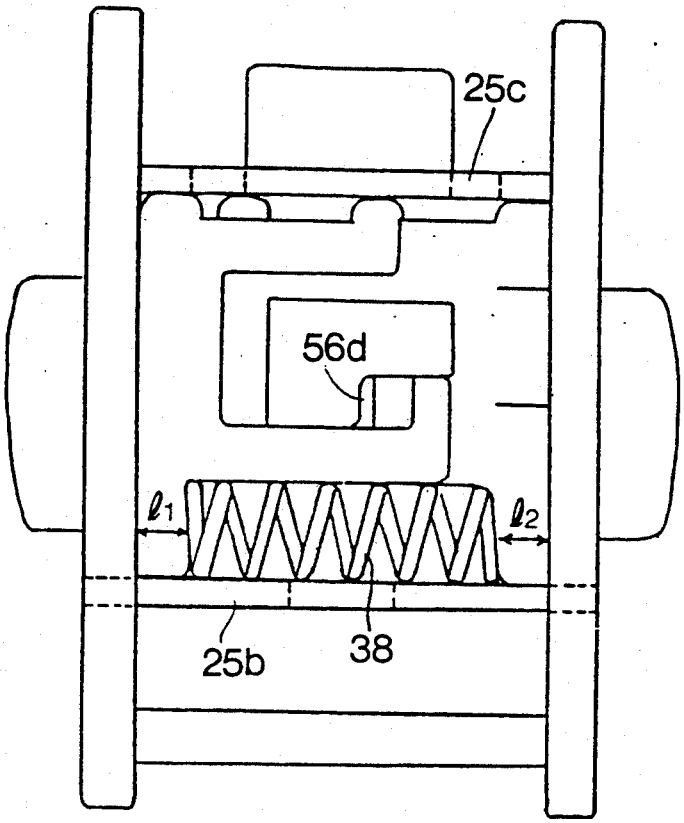
FIG. 11 is a plan view showing the buckle of FIG. 9.
Figure 12:
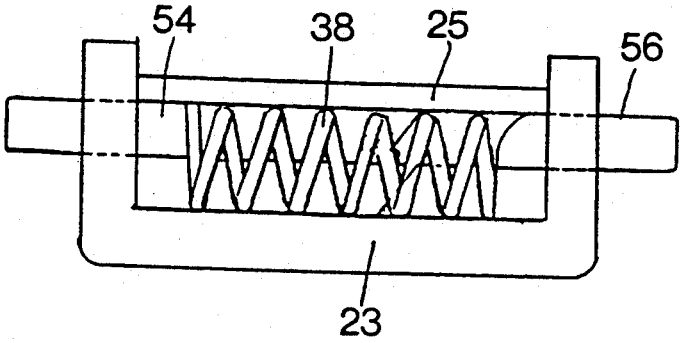
FIG. 12 is a sectional view of the buckle.

Referring to FIGS. 11 and 12, the coil spring 38 is disposed in the space defined by the L-shaped retainer portion 56*a* of the pressing-up lever 56, the L-shaped retainer portions 54*a* of the lock lever 54 mounted on the lever 56, the cover 25, the side plate 25*b* and the base frame 23.

If widths 11 and 12 of the projecting ends 54*c* and 56*c* are minimized within an allowable range of press working, the space for the coil spring 38 (length of the coil spring) becomes maximum, so that the spring 38 having a sufficient resilient force can be employed.

The L-shaped retainer portion 56*a* of the pressing-up lever 56 extends over a pressing up slant 56*d* to form one side of the space for the spring 38. Thus, such an accident that a part of the coil spring 38 enters the space under the lock lever 54, which disables the levers 54 and 56 from returning to the home positions, does not occur.

Since the side portion of each L-shaped retainer portion 54*a* (56*a*) engages with the periphery of the spring 38 so that the lateral displacement of the lever 54 (56) is restricted by the spring when operating.

Since the levers 54 and 56 are partially overlapped with each other and guided by the side plates 25*b* and 25*c* of the cover 25, the levers are smoothly moved during operation. Thus, even if a spring having a small elastic force is used, the spring reliably urges both the levers to the corresponding side frames. Consequently, the levers can be operated by a small pressing force.

In order to reduce the thickness of the buckle, if the thickness of both the levers 54 and 56 are reduced, the height of the cover plate 31 heaved by the upward slant 56*d* reduces. In order to keep the necessary height for the cover plate 31, it is necessary to increase the height of the composite member 34 and the length of the slant 34*a* of the composite member 34. However, it is impossible to increase the height of the composite member 34 without increasing the thickness of the buckle. Such an increase can be achieved by forming a hole in the base frame 23 and inserting the lower end of the composite member 34 into the hole.

FIGS. 13 to 16 show a buckle of the third embodiment. In the first and second embodiments, the first engaging member 10 is secured to the end of the band 37. A first engaging member of the buckle of the third embodiment has a clamping spring member 60 for attaching the first engaging member to a band 72 at a preferable position. Namely, the effective length of the band 72 can be adjusted by changing the position of the first engaging member. The clamping spring member 60 comprises a body 61 having a U-shaped section. The body 61 is rotatably mounted on a pin 62 laterally provided between side frames 66 and 67 of the frame member of the buckle. A clamping portion 63 is formed on a lower portion of the body 61 to be inserted into the underside of the pin 62 for clamping the first engaging member to the band 72.

The frame member comprises a pair of lateral base frames 64 and 65, supporting plates 68 and 69 inwardly projected from the side frames 66 and 67 for supporting a lock mechanism. The lock mechanism comprises a lock lever 70 and a pressing up lever 71. The levers 70 and 71 are similar to the lock lever 54 and the pressing-up lever 56 of the second embodiment. Each of the levers 70 and 71 has a more simplified construction than the second embodiment but has the same functions as the second embodiment. Other parts are the same as the second embodiment in construction and the same parts thereof are identified with the same reference numerals of FIGS. 9 to 12.

Figure 13:
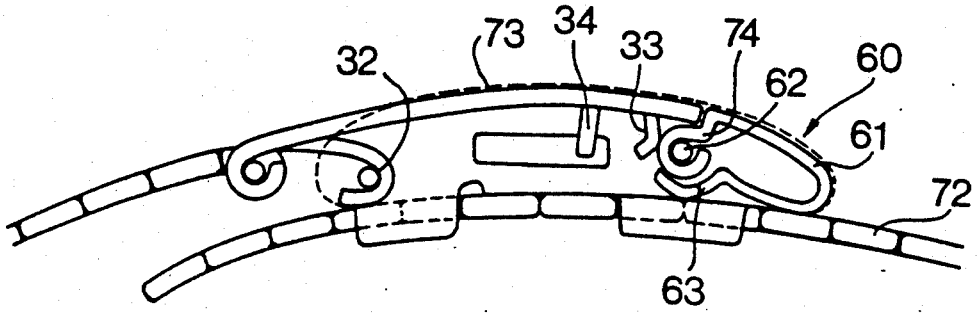
FIG. 13 is a side view showing a buckle of a third embodiment.
Figure 14:
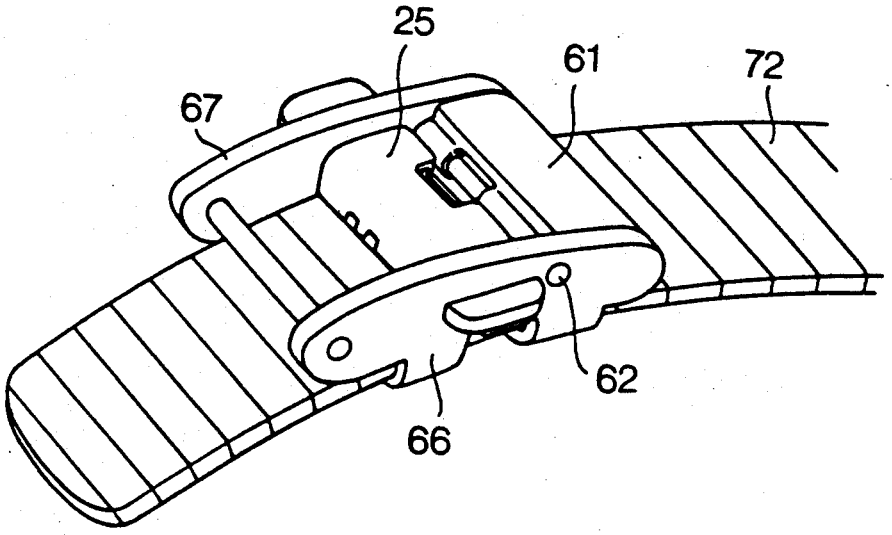
FIG. 14 is a perspective view showing a first engaging member of the buckle of FIG. 13.
Figure 15:
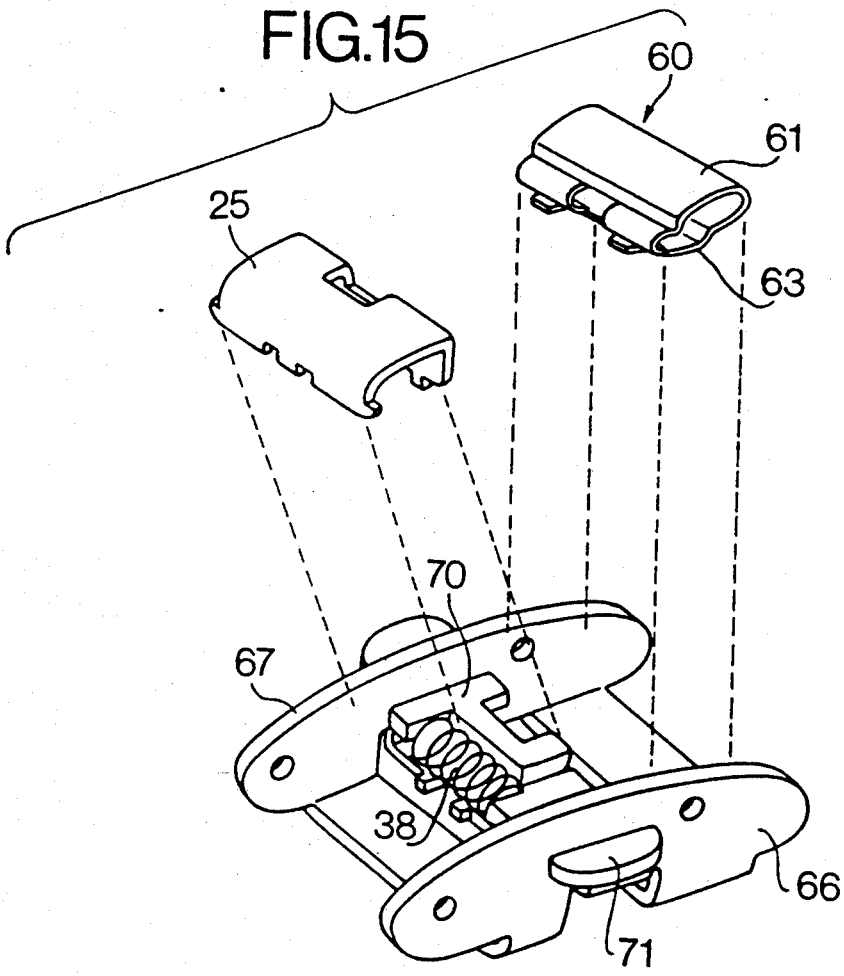
FIG. 15 is an exploded perspective view of the first engaging member.
Figure 16:
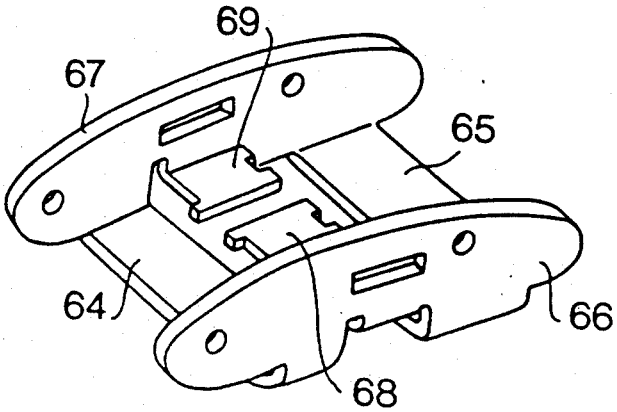
FIG. 16 is a perspective view showing a frame member of the buckle.

The band 72 is inserted between the base frames 64 and 65 and the supporting plates 68 and 69. As shown in FIG. 13, the clamping portion 63 of the clamping spring member 60 is pressed against the band 72 so that the first engaging member is secured to the band 72. At that time, the outside contour of the clamping spring member 60 coincides with contours of the side frames 66 and 67. An end of a cover plate 73 connected to the other band is engaged with a shoulder 74 formed on the clamping spring member 60 when the cover plate 73 is coupled to the first engaging member. In the coupled state, the end of the cover plate 73 flushes with the upper surface of the clamping spring member 60 and the contour thereof coincides with the peripheries of the side frames 66 and 67.

In order to change the position of the first engaging member on the band 72, the clamping spring member 60 is rotated by a tool to disengage the clamping portion 63 from the band 72.

The invention being thus described, it will be obvious that the same may be varied in many ways. Such variations are not to be regarded as a departure for the spirit and scope of the invention, and all such modifications as would be obvious to one skilled in the art are intended to be included within the scope of the following claims.

In accordance with the present invention, a buckle which is compact in size and balanced in design can be provided. Since the number of parts of the buckle is small, the buckle can be easily manufactured at a low manufacturing cost.

We claim:

1. A buckle for a watch with opposite bands, the buckle having a first engaging member and a second engaging member, the first engaging member comprising a frame member having at least one base frame and a pair of side frames, each of the side frames having a hole, the holes correspond to one another with both holes being located at the same height in the side frames, a lock lever having a locking portion, and a pressing-up lever having a body and a pressing-up slant on the body, each of the levers being laterally slidable relative to the side frames and being mounted in the frame member and having an operating lug projected from the hole of one of the side frames, and the second engaging member comprising a lock member engageable with the lock lever and a slant member to be raised by the pressing-up lever, a spring being provided between the lock lever and the pressing-up lever so as to urge outwardly both of the levers characterized in that the pressing-up lever is located lower than the lock lever, and the locking portion of the lock lever and the body of the pressing-up lever are disposed so as to overlap with each other, and a surface of the operating lug of one of the levers is located higher than the body by a height substantially equal to a thickness of the locking portion so that the operating lug is inserted into the corresponding hole.

2. The buckle according to claim 1 wherein the spring is disposed between an inner end of one of the levers and a bent portion of the other lever.

3. The buckle according to claim 2 wherein the spring is made of a spring plate and disposed between an end of the lock lever and a bend portion of the pressing-up lever so as to urge both the levers to the side frames.

4. The buckle according to claim 1 wherein the lock lever is flat and the pressing-up slant of the pressing-up lever is located at a different height than the operating lug thereof.

5. The buckle according to claim 1 wherein the first engaging member has a cover having a pair of lateral side plates at both ends in the longitudinal direction of the band, the cover is secured to the frame member, sides of the lock lever and the pressing-up lever engage with the side plates so as to be moved along the side plates.

6. The buckle according to claim 4 wherein each lever has regulating ends at end portions thereof, which engage with the lateral side plates of the cover so as to be moved along the lateral side plates.

7. The buckle according to claim 4 5 wherein each lever has an L shaped retainer portion, the spring is disposed in a space defined by the L-shaped retainer portions, the cover, a base frame of the frame member and one of the lateral side plates.

8. The buckle according to claim 1 wherein the first engaging member is secured to the band by a clamping spring member, the second engaging member comprises a cover plate having a lock member and a slant member, the cover plate engages with the clamping spring member at an end thereof, and the surface of the cover plate flushes with the upper surface of the clamping spring member in the coupling state.

* * * * *